US005800094A

United States Patent [19]

Jones

[11] Patent Number: 5,800,094

[45] Date of Patent: Sep. 1, 1998

[54] APPARATUS FOR LIFTING AND SUPPORTING STRUCTURES

[76] Inventor: Robert L. Jones, 29505 Golden Gate Canyon Rd., Golden, Colo. 80403

[21] Appl. No.: 795,598

[22] Filed: Feb. 5, 1997

[51] Int. Cl.[6] ..... E02D 5/00

[52] U.S. Cl. ..... 405/230; 254/133 R

[58] Field of Search ..... 405/229, 230, 405/231; 254/133 R, 134

[56] References Cited

U.S. PATENT DOCUMENTS

| | | | |
|---|---|---|---|
| 3,685,301 | 8/1972 | Heacox . | |
| 3,796,055 | 3/1974 | Mahony . | |
| 3,902,326 | 9/1975 | Langenbach . | |
| 4,070,867 | 1/1978 | Cassidy . | |
| 4,634,319 | 1/1987 | May . | |
| 4,800,700 | 1/1989 | May . | |
| 4,911,580 | 3/1990 | Gregory et al. . | |
| 5,011,336 | 4/1991 | Hamilton et al. . | |
| 5,116,355 | 5/1992 | Freeman . | |
| 5,120,163 | 6/1992 | Holdeman et al. . | |
| 5,139,368 | 8/1992 | Hamilton et al. . | |
| 5,154,539 | 10/1992 | McCown, Sr. et al. | 405/230 |
| 5,171,107 | 12/1992 | Hamilton et al. . | |
| 5,176,472 | 1/1993 | Kinder | 405/230 |
| 5,213,448 | 5/1993 | Seider et al. . | |
| 5,217,325 | 6/1993 | Freeman . | |
| 5,246,311 | 9/1993 | West et al. | 405/230 |
| 5,336,021 | 8/1994 | Freeman . | |
| 5,433,556 | 7/1995 | Freeman . | |
| 5,482,407 | 1/1996 | Raaf . | |
| 5,722,798 | 3/1998 | Gregory | 405/230 |

*Primary Examiner*—Tamara L. Graysay
*Assistant Examiner*—Frederick L. Lagman
*Attorney, Agent, or Firm*—Dorr, Carson, Sloan & Birney, P.C.

[57] ABSTRACT

An apparatus for lifting and supporting the foundation of a structure employs a pier anchored into the ground adjacent to the foundation, a support assembly attached to the upper end of the pier, and a lifting assembly that can be removably seated over the base of the support assembly. The support assembly includes a support bracket for engaging the foundation, and at least two threaded rods with nuts for adjustably controlling the vertical distance between the base and the support bracket on the rods. The lifting assembly is removably seated over the base of the support assembly between the rods, and has side members extending laterally outward beyond the support bracket for supporting jacks to lift the foundation.

15 Claims, 4 Drawing Sheets

APPARATUS FOR LIFTING AND SUPPORTING STRUCTURES

BACKGROUND OF THE INVENTION

1. Field of the Invention

The present invention relates generally to the field of piering systems for lifting and stabilizing the foundation of a structure. More specifically, the present invention discloses a piering system that employs a support assembly and a removable lifting assembly.

2. Statement of the Problem

Piering systems have long been used to lift and stabilize the foundations of structures. Some systems employ piers that are driven into the ground adjacent to the foundation, while other piering systems employ helical piers that are screwed into the ground. In either case, an assembly must be attached to the upper end of each pier to lift the foundation and then support it at its desired elevation. A wide variety of such devices have been used in the past, including the following:

| Inventor | U.S. Pat. No. | Issue Date |
|---|---|---|
| Heacox | 3,685,301 | Aug. 22, 1972 |
| Mahony | 3,796,055 | Mar. 12, 1974 |
| Langenbach | 3,902,326 | Sept. 2, 1975 |
| Cassidy | 4,070,867 | Jan. 31, 1978 |
| May | 4,634,319 | Jan. 6, 1987 |
| May | 4,800,700 | Jan. 31, 1989 |
| Gregory et al. | 4,911,580 | Mar. 27, 1990 |
| Hamilton et al. | 5,011,336 | Apr. 30, 1991 |
| Freeman | 5,116,355 | May 26, 1992 |
| Holdeman et al. | 5,120,163 | June 9, 1992 |
| Hamilton et al. | 5,139,368 | Aug. 18, 1992 |
| Hamilton et al. | 5,171,107 | Dec. 15, 1992 |
| Seider et al. | 5,213,448 | May 25, 1993 |
| Freeman | 5,217,325 | June 8, 1993 |
| Freeman | 5,336,021 | Aug. 9, 1994 |
| Freeman | 5,433,556 | July 18, 1995 |
| Raaf | 5,482,407 | Jan. 9, 1996 |

Heacox, Langenbach, and Cassidy disclose examples of systems for driving piles.

Mahony discloses a method for underpinning and raising a building foundation using the steps of forming a pit alongside the foundation, disposing a pipe upright in the pit, gripping the side of the pipe while progressively exerting a hydraulic drive force against the reactive force of the weight of the foundation so as to drive the pipe into the ground. The last step is repeated until the pipe has been driven to a desired depth. A jacking pad is then formed and supported on the upper end of the pipe. After the pad hardens, the foundation is jacked upwardly away from the pad.

The May '319 patent discloses a method for lifting and supporting a structure using the steps of exposing the base of the structure, attaching a shoe to the base and then attaching a driving assembly to the shoe that can be used to drive a series of piers beneath the structure. The piers are then cut off at ground level and separate pier plate is fitted over the end of each pier. The pier plate is used to support lifting means for lifting the structure to the desired position. After the structure has reached this position, permanent adjustable supporting means are placed between the pier plate and structure to retain the structure in the desired position.

The May '700 patent discloses a method for lifting and supporting a concrete slab using the steps of cutting an access hole in the slab, inserting a lift plate through the access hole, rotating and drawing the lift plate up against the underside of the slab, and driving a pier through the access hole to bedrock. After a series of pier have been driven, lifting means are attached to the lift plates to raise the slab to a desired level. The lift plates are then secured to the piers to maintain the slab in its desired permanent location.

Gregory et al. disclose an apparatus and method for raising and supporting a building foundation. A lifting arm 12 is inserted under the foundation and a pair of hydraulic rams **32*a* and 32*b*** are used to drive the piling into the ground.

The Freeman patents disclose a system that uses a series of pipe sections that are driven into the ground until bedrock is reached. A loading bracket 81 is then seated over the upper end of the pipe. Two jacks 99 symmetrically located on either side of the bracket are used to raise and support the footing 5 until the bolt 77 is tightened to permanently support the footing. The jacks 99 push against a bearing plate 79 beneath the footing 5, rather than on the footing itself.

Holdeman et al. disclose an apparatus for stabilizing the foundation of a building. A helical pier 16 is screwed into the ground adjacent to the foundation 10, and a foundation support bracket 28 is placed under the edge of the foundation. An inverted U-shaped coupler 94 secured to the foundation support bracket has a jack 102 extending between the top of the coupler and the foundation support bracket 28 to lift the foundation. The jack and coupler 94 can be removed after bolts 78, 80 have been tightened.

The three patents to Hamilton et al. disclose a system for underpinning a foundation that uses a helical pier 16 with a connecting bracket assembly 18 secured to the foundation 10. The helical pier 16 is screwed into the ground beneath the foundation. The bracket assembly 18 includes a plate 28 with a pair of outwardly extending wall portions 30, 32. A U-shaped bracket 36 together with a mating retainer 42 are releasably secured to the wall portions 30, 32 and serve to retain the upper end of the helical pier 16. A bolt 54 is threaded into the top cross-piece 38 of the U-shaped bracket 36 and engages the upper end of the helical pier shaft 20 as shown in FIG. 3 of these patents.

Seider et al. disclose an underpinning bracket for stabilizing the foundation of a building that includes a support assembly fastened to the foundation and a screw assembly (i.e., a helical pier) that is driven into the ground. The upper end of the screw assembly is secured with a sleeve of the support assembly by a bonding composition to prevent movement of the screw relative to the sleeve.

Raaf discloses an outrigger assembly with two helical anchors that are temporarily sunk into the ground for stabilization while driving piers or pilings.

The prior art devices suffer from a number of shortcomings. Many of these devices are very complicated and would be relatively expensive to manufacture and difficult to use in the field. Others place large bending moments on the pier. Others make access difficult by placing both the jack(s) and support mechanism in close proximity beneath the shoe or support bracket holding the foundation.

3. Solution to the Problem. None of the prior art references listed above show a piering system having the present structure. The lifting assembly can be easily attached to and removed from the support assembly in the present invention. This permits the lifting assembly to be reused repeatedly. The configuration of the lifting assembly also provides sufficient room for easy access to the jacks and nuts.

Furthermore, the support bracket is attached to the foundation directly above the pier, rather that being laterally offset. This minimizes the net bending moment on the shaft of the pier. Also, the threaded rods are symmetrically offset relative to the pier so that the net moment on the pier is minimized.

In addition, the jacks are used to directly lift the structure instead of the support bracket. This makes it easier to adjust the position of the shoe and tighten the nuts before the jacks are removed.

SUMMARY OF THE INVENTION

This invention provides an apparatus for lifting and supporting the foundation of a structure that employs a pier anchored into the ground adjacent to the foundation, a support assembly attached to the upper end of the pier, and a lifting assembly that can be removably seated over the base of the support assembly. In particular, the support assembly includes a support bracket for engaging the foundation, and at least two threaded rods with nuts for adjustably controlling the vertical distance between the base and the support bracket on the rods. The lifting assembly is removably seated over the base of the support assembly between the rods, and has side members extending laterally outward beyond the support bracket for supporting jacks to lift the foundation.

A primary object of the present invention is to provide a piering system with a lifting assembly that can be easily removed and reused on a series of piers.

Another object of the present invention is to provide a piering system that minimizes the bending moment on the pier.

Another object of the present invention is to provide a piering system that provides convenient access to the jacks used to lift the structure, and to the nuts used to secure the support assembly in final position.

Yet another object of the present invention is to provide a piering system that is simple, reliable, and can be manufactured economically.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
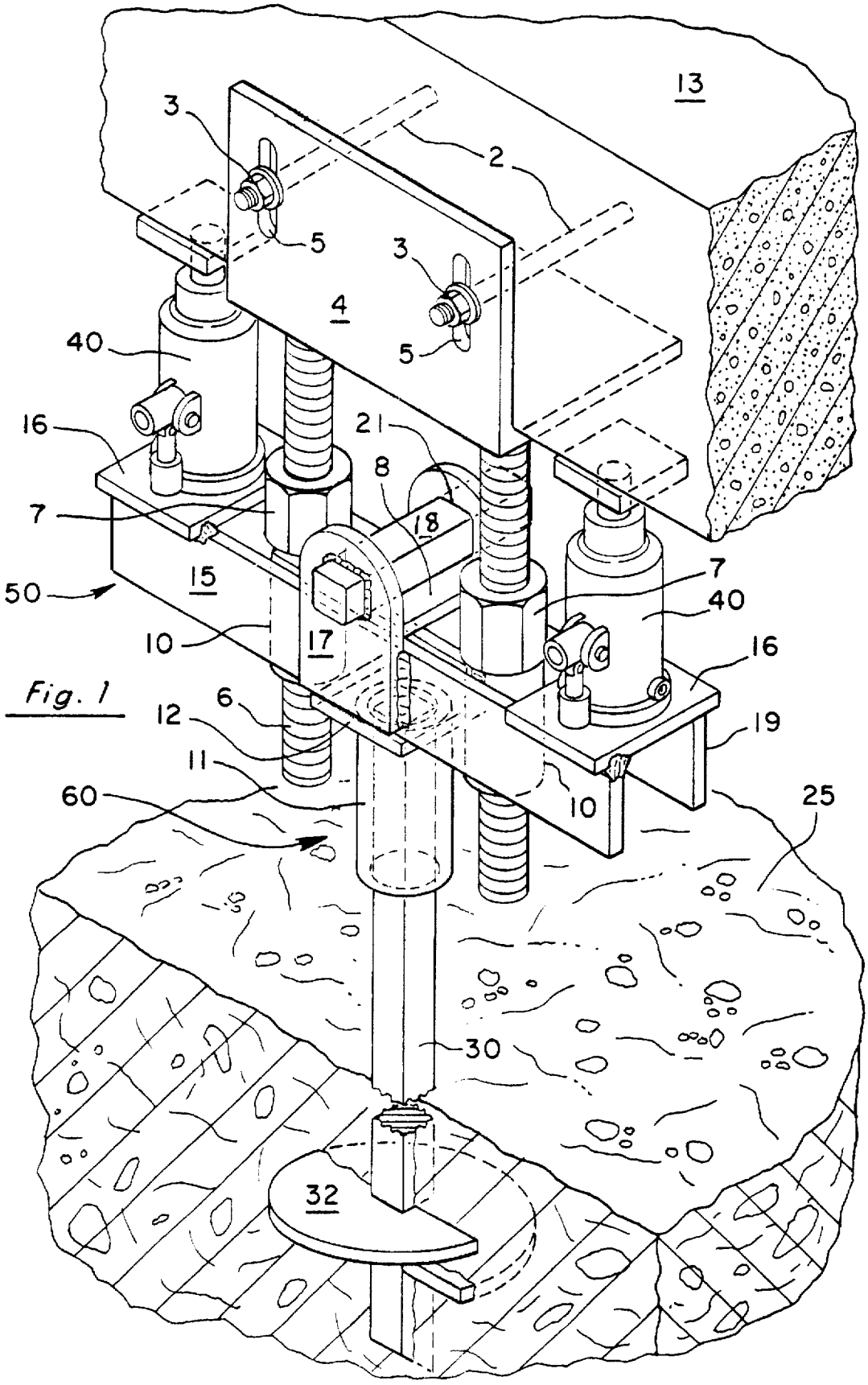
FIG. 1 is a front perspective view of the present invention with a portion of the ground 25 cut away to reveal the lower end of the helical pier 32.
Figure 2:
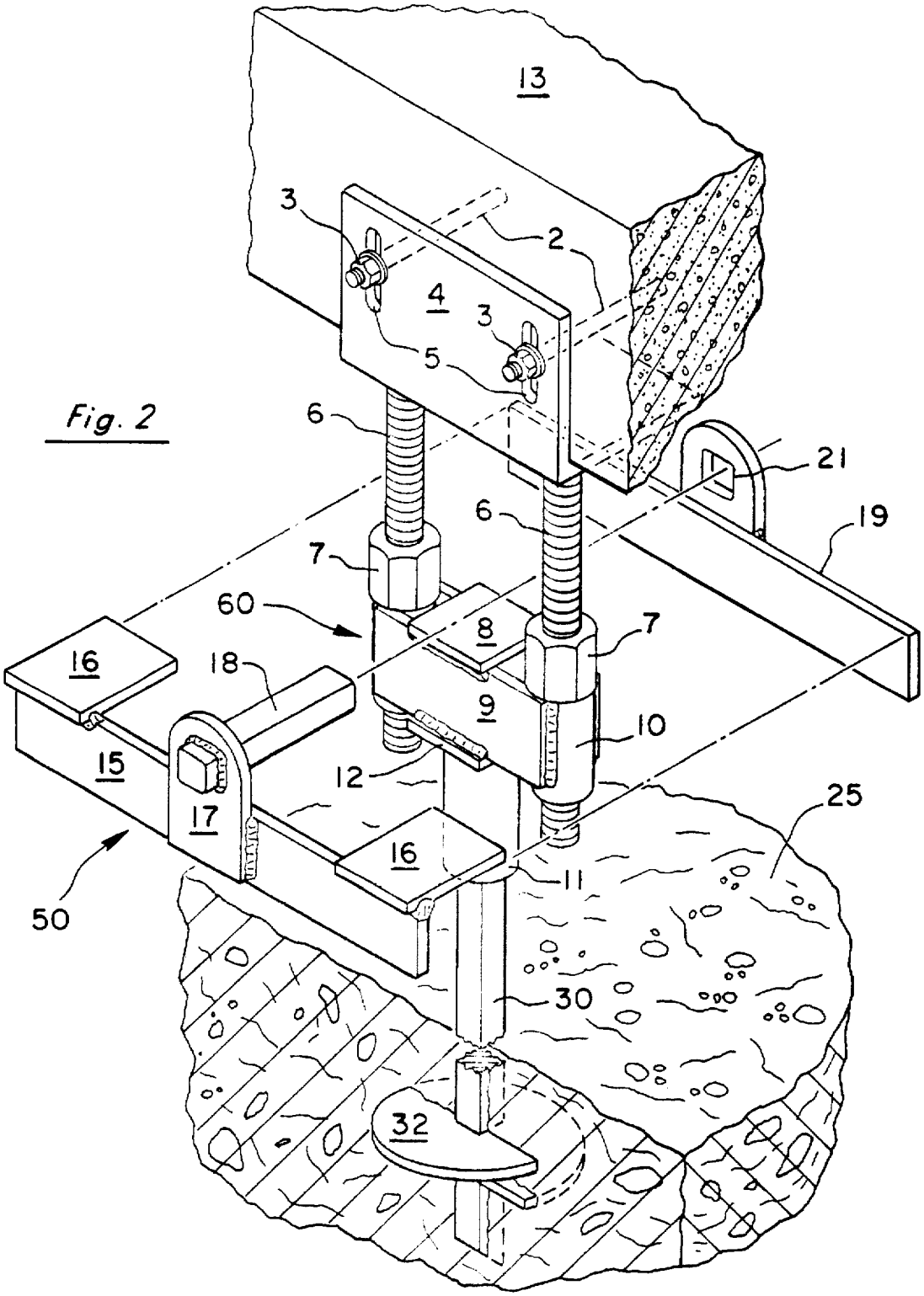
FIG. 2 is another front perspective view of the present invention that includes an exploded view of the lifting assembly 50.
Figure 3:
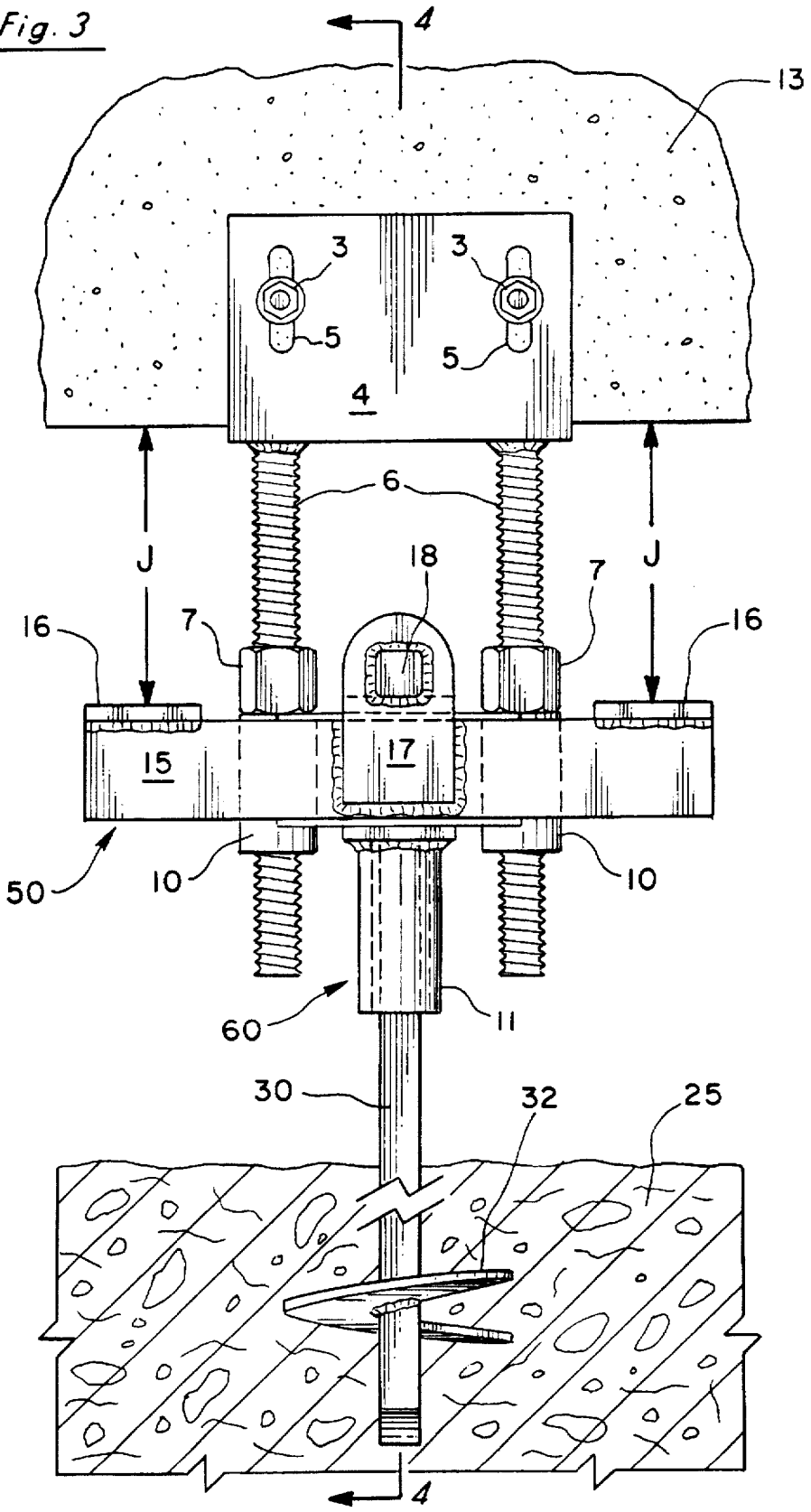
FIG. 3 is a front elevational view of the present invention after nuts 7 have been tightened and the jacks have been removed.

Turning to FIGS. 1 and 2, two front perspective views are provided illustrating the present invention. The major components of the present invention are the support assembly 60, which is used to permanently support the building foundation 13, and a lifting assembly 50, which is temporarily seated over the support assembly and is used to lift the foundation 13. As is shown most clearly in FIG. 2, the support assembly 60 actually consists of a series of subcomponents, including a support bracket 4, two threaded rods 6, two nuts 7, and a base 8–12. The L-shaped support bracket 4 engages and supports the exposed edge of the foundation 13. A series of concrete expansion bolts 2 can be fastened into the foundation 13 to provide lateral support. The ends of the bolts pass through slotted holes 5 in the support bracket 4 and are fastened with nuts 3. Two threaded rods 6 extend downward from the support bracket 4 through the base of the support assembly 60. A gusset plate 14 (shown in FIG. 4) can be welded between the support bracket and each rod 6 to reinforce these joints.

The base of the support assembly 60 consists of four spacer plates 8, 9, and 12, two pipe sleeves 10, and a tubular member 11. The lower ends of the threaded rods 6 pass freely through the pipe sleeves 10. Two nuts 7 are threaded on the rods 6 above the base. These nuts 7 are too large to pass through the upper openings of the pipe sleeves 10, and therefore sit on top of the pipe sleeves 10. The position of the nuts 7 on the threaded rods can be used to adjustably control the vertical distance between the base and the support bracket 4. The pipe sleeve 11 at the bottom of the base fits over the upper end 30 of the pier 32 as previously mentioned.

The preferred embodiment shown in the drawings uses two sets of threaded rods 6 and nuts 7 to support the support bracket 4 above the base. However, it should be expressly understood that any number of sets of rods and nuts could be employed depending on the structural requirements of the job, the number of piers, and the structural limitations of the components used. In addition, other equivalent mechanisms could be used for adjusting the vertical separation between the base and support bracket 4, although the preferred embodiment has the advantages of simplicity, ease of use, and strength.

Figure 4:
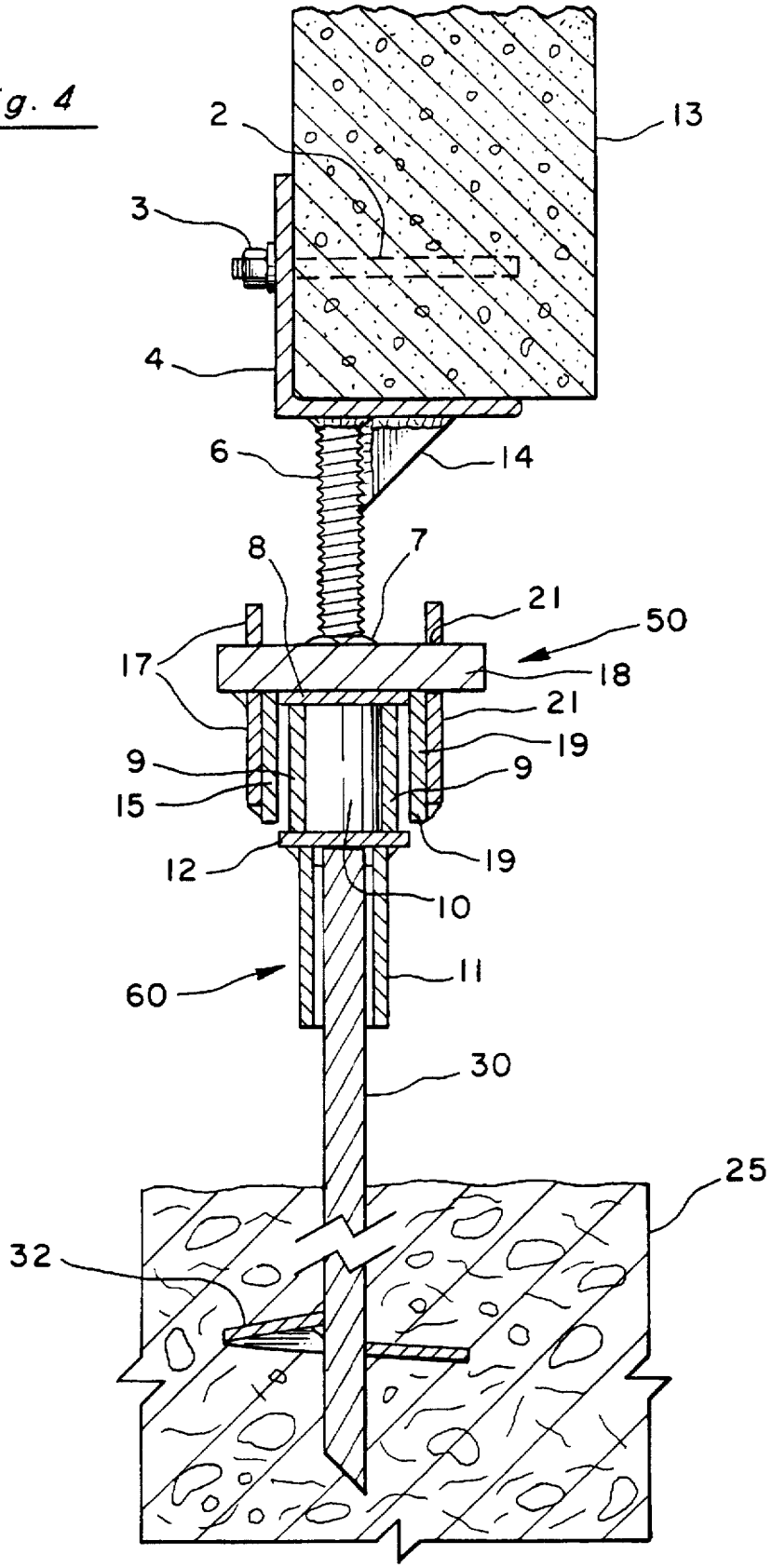
FIG. 4 is a vertical cross-sectional view of the present invention corresponding to FIG. 3.

After the support assembly 60 has been attached to the pier 32 and foundation 13, a lifting assembly 50 is temporarily mounted over the support assembly as depicted in FIG. 2. The lifting assembly includes a first member 15 that has a short spacer bar 18 extending perpendicularly from its midsection 17. This spacer bar 18 is placed across the upper surface 8 of the support assembly base between the threaded rods 6, as illustrated in FIGS. 2 and 4. A second member 19 removably engages the spacer bar 18 along the rear face of the support assembly base. For example, as shown in FIG. 2, the second member 19 can be equipped with an opening 21 to receive the distal end of the space bar 18.

When assembled, the opposing ends of the first and second members 15 and 19 form two arms that extend laterally outward beyond the edges of the support bracket 4. Two horizontal platforms 16 are welded to the ends of the first member 15 beyond the support bracket 4. The ends of the second member 19 underlay and support these horizontal platforms 16 when the lifting assembly is complete. The horizontal platforms serves as bases to support two jacks 40 used to lift the foundation 13.

Operation of the present invention is described in the following section. A portion of the building is excavated to expose the building's foundation 13. A pier 32 is then anchored into the ground 25 adjacent to the foundation 13. In the embodiment shown in the drawings, the pier 32 is a helical pier that is screwed into the ground to a desired depth beneath the foundation 13. However, other types of piers could be substituted. In any case, the upper end 30 of the pier 32 remains exposed above the surface of the ground 25 and beneath the foundation 13.

The support assembly 60 is then attached to the pier 32 by inserting the upper end 30 of the pier 32 into the tubular member 11. The nuts 7 on the threaded rods 6 are manually adjusted to raise the support bracket 4 into contact with the foundation 13. Holes are drilled into the foundation 13 through the slots 5 for installation of the concrete expansion bolts 2. The bolts are then inserted through the slots 5 in the support bracket 4 and threaded into the foundation 13. The bolts 2 are secured to the support bracket 4 by means of nuts 3.

The first member 15 of the lifting assembly 50 is placed in position against the front face 9 of the support assembly base with the spacer bar 18 extending across the top 8 of the support assembly base. The second member 19 of the lifting assembly 50 is then placed in position against the rear face of the support assembly. The Distal end of the spacer bar 18 is received in the opening 21 of the second member 19 to hold the assembly together. The ends of the second member 19 also contact the undersurface of the jack platforms 16 for added structural support.

Two hydraulic jacks 40 are placed on the platforms 16 at either end of the lifting assembly 50. The platforms are located beyond the edges of the support bracket 4 so that the heads of the jacks 40 will contact the foundation 13, rather than the support bracket 4. The jacks 40 are raised to lift the foundation to its desired elevation. As this occurs, the bolts 2 lift the support bracket 4, threaded rods 6, and nuts 7 with the foundation 13. The threaded rods 6 pass freely through the openings in the support assembly base, so the base is not lifted.

After the foundation 13 has been raised to the desired elevation, the nuts 7 are turned downward until they come firmly into contact once again with the top of the support assembly base. This allows the support bracket 4, rods 6, nuts 7, and the base of the support assembly to begin to support the foundation 13. The jacks 40 are then lowered to remove the load on the lifting assembly 50. The jacks 40 are removed from the platforms 16, and the lifting assembly 50 is removed from the support assembly 60 to complete the operation.

It should be noted that the lifting assembly and jacks can be re-used repeatedly for a series of piers and supports assemblies. In addition, the lifting assembly can be readily reinstalled on an existing support assembly, if necessary, to further adjust the elevation of the foundation. The configuration of the lifting assembly also provides sufficient room for easy access to the jacks and nuts.

The vertical alignment of the support bracket and foundation directly above the pier minimizes the net bending moment on the shaft of the pier. Also, the threaded rods are symmetrically offset relative to the pier so that the net moment on the pier is minimized.

The above disclosure sets forth a number of embodiments of the present invention. Other arrangements or embodiments, not precisely set forth, could be practiced under the teachings of the present invention and as set forth in the following claims.

I claim:

1. An apparatus for lifting and supporting the foundation of a structure relative to the ground, said apparatus comprising:

a pier anchored into the ground having an upper end adjacent to a selected portion of the foundation;

a support assembly having:

(a) a base attached to said upper end of said pier;

(b) a support bracket for engaging the foundation;

(c) a plurality of substantially vertical rods supporting said support bracket above said base; and (d) means for adjustably controlling the vertical distance between said base and said support bracket on said rods; and a removable lifting assembly having:

(a) means for removably seating said lifting assembly on said base of said support assembly; and (b) two arms extending laterally outward beyond said support bracket for supporting jacks to lift the foundation.

2. The apparatus of claim 1 wherein said arms of said lifting assembly further comprise horizontal platforms for supporting the jacks.

3. The apparatus of claim 1 wherein said rods are threaded, and said means for adjustably controlling the vertical distance between said base and said support bracket comprise nuts on said threaded rods.

4. The apparatus of claim 1 wherein said lift assembly further comprises:

a first member having two opposing ends forming a portion of said arms;

a spacer bar extending from said first member across said base between said rods;

two horizontal platforms secured to said ends of the said first member beyond said support bracket; and a second member having means for removably engaging said spacer bar, and two opposing ends supporting said horizontal platforms.

5. The apparatus of claim 1 wherein said lift assembly is seated between said rods.

6. The apparatus of claim 1 wherein said rods are threaded and extend downward from said support bracket through openings in said base, and wherein said means for adjustable controlling the vertical distance between said base and said support bracket further comprise nuts on said threaded rods.

7. The apparatus of claim 1 wherein base of said support assembly further comprises:

a tubular member for receiving the upper end of the pier;

an upper surface for supporting said lifting assembly; and a plurality of openings extending through said base for receiving said rods.

8. An apparatus for lifting and supporting the foundation of a structure relative to the ground, said apparatus comprising:

a pier anchored into the ground having an upper end adjacent to a selected portion of the foundation;

a support assembly having:

(a) a base attached to said upper end of said pier having a plurality of vertical openings;

(b) a support bracket for engaging the foundation;

(c) a plurality of threaded rods extending downward from said support bracket through said openings in said base; and (d) nuts on said threaded rods for adjustably controlling the vertical distance between said base and said support bracket; and a removable lifting assembly having:

(a) means for removably seating said lifting assembly on said base between said rods of said support assembly; and (b) two arms extending laterally outward beyond said support bracket for supporting jacks to lift the foundation.

9. The apparatus of claim 8 wherein said arms of said lifting assembly further comprise horizontal platforms for supporting the jacks.

10. The apparatus of claim 8 wherein said lift assembly further comprises:

a first member having two opposing ends forming a portion of said arms;

a spacer bar extending from said first member across said base between said rods;

two horizontal platforms secured to said ends of the said first member beyond said support bracket; and a second member having means for removably engaging said spacer bar, and two opposing ends supporting said horizontal platforms.

11. The apparatus of claim 8 wherein base of said support assembly further comprises:

a tubular member for receiving the upper end of the pier;

an upper surface for supporting said lifting assembly; and a plurality of openings extending through said base for receiving said rods.

12. An apparatus for lifting and supporting the foundation of a structure relative to the ground, said apparatus comprising:

a pier anchored into the ground having an upper end adjacent to a selected portion of the foundation;

a support assembly having:

(a) a base attached to said upper end of said pier having:

(1) a plurality of vertical openings; and (2) an upper surface between said openings;

(b) a support bracket for engaging the foundation;

(c) a plurality of threaded rods extending downward from said support bracket through said openings in said base; and (d) nuts on said threaded rods for adjustably controlling the vertical distance between said base and said support bracket; and a removable lifting assembly having:

(a) a first member having two opposing ends extending laterally outward beyond said support bracket;

(b) two horizontal platforms secured to said ends of the said first member beyond said support bracket for supporting jacks to lift the foundation;

(c) a spacer bar extending from said first member across said upper surface of said base; and (d) a second member having means for removably engaging said spacer bar to seat said lifting assembly on said base.

13. The apparatus of claim 12 wherein said second member has an opening for removably engaging said spacer bar.

14. The apparatus of claim 12 wherein said base of said support assembly further comprises a tubular member for receiving the upper end of the pier.

15. The apparatus of claim 12 wherein said second member of said lifting assembly further comprises two opposing ends supporting said horizontal platforms.

* * * * *